US005163723A

United States Patent [19]

Rückert

[11] Patent Number: 5,163,723

[45] Date of Patent: Nov. 17, 1992

[54] CLOSURE FOR DOORS, FLAPS OR THE LIKE

[75] Inventor: Edvard Rückert, Velbert, Fed. Rep. of Germany

[73] Assignee: Ewald Witte & Co., Velbert, Fed. Rep. of Germany

[21] Appl. No.: 706,749

[22] Filed: May 28, 1991

[51] Int. Cl.[5] ..... E05C 3/26

[52] U.S. Cl. ..... 292/216; 292/DIG. 41

[58] Field of Search ..... 292/216, 280, 336.3, 292/DIG. 41

[56] References Cited

U.S. PATENT DOCUMENTS 3,334,935 8/1967 Eddy ..... 292/216
3,876,238 4/1975 Watermann ..... 292/216
3,917,330 11/1975 Quantz ..... 292/216
4,896,907 1/1990 Hayakawa et al. ..... 292/DIG. 41

FOREIGN PATENT DOCUMENTS 3717013 11/1987 Fed. Rep. of Germany .

*Primary Examiner*—Richard E. Moore
*Attorney, Agent, or Firm*—Martin A. Farber

[57] ABSTRACT

A lock for doors, hinged covers or the like, particularly on motor vehicles, having a rotary fork latch which captures a closure member and engages in closed position with a locking pawl. In order that the lock remain in a dependable closed position even in the event of the action of transverse forces, the rotary fork latch (8) and the locking pawl (14) are in a form-locked engagement which is active in the direction of the support pin of the rotary fork latch (8).

6 Claims, 4 Drawing Sheets

CLOSURE FOR DOORS, FLAPS OR THE LIKE

FIELD AND BACKGROUND OF THE INVENTION

The present invention relates to a lock for doors, hinged covers or the like, particularly on motor vehicles, having a rotary fork latch which captures a closure member and engages in closed position with a locking pawl.

Such an arrangement is known from Federal Republic of Germany OS 37 17 013. The closure member which is arranged on the door engages in the rotary fork latch during the closing movement of the door and swings the latch into a position which secures the closure member. The final position of rotation of the rotary fork latch is secured by the locking pawl which so engages the rotary fork latch that the latter cannot turn by itself in backward direction. Only when the engagement of the locking pawl with the rotary fork latch has been intentionally removed by suitable means, does the rotary fork latch swing back and release the closure member for the opening of the door. The rotary fork latch and the locking pawl are developed as flat parts, preferably as steel-plate stampings. The fact is disadvantageous that, upon transverse forces on the lock, the rotary fork latch and locking pawl can slide laterally towards each other, as a result of which the lock opens by itself. Such transverse forces can occur on a motor vehicle, for instance, in the event of extreme loads on the chassis (twisting) or can be brought about by forceful manipulations (breaking-in).

SUMMARY OF THE INVENTION

The object of the invention is, therefore, to provide a lock of the aforementioned type which remains in securely locked position even under the action of transverse forces.

This object is achieved in accordance with the invention in the manner that the rotary fork latch and the locking pawl are in a form-locked engagement which is active in the direction towards the support pin of the rotary fork latch. Therefore, as soon as forces or components of forces in the direction of the support pin of the rotary fork latch act on the lock, the rotary fork latch and the locking pawl will rest against each other as a result of the form-locked connection so that lateral sliding of the parts cannot occur. Even upon the application of force, the cooperating parts cannot be deformed laterally with respect to each other since even in the event that one part should bend, the other part will be carried along as a result of the form-locked connection.

In accordance with a further development of the invention, the form lock is formed by a projection-recess arrangement. The form-locked engagement is preferably assumed in the closed position of the rotary fork latch.

It is immaterial for the lock in accordance with the invention whether the rotary fork latch and locking pawl are arranged on the door and the closure member is arranged on the frame or whether the rotary fork latch and the locking pawl are arranged on the frame and the closure member is accordingly arranged on the door. It is merely important that the form lock in accordance with the invention is effective in the transverse direction in which the sliding away of rotary fork latch and locking pawl is to be avoided. To this extent, this form lock may be present in the one transverse direction or else in the opposite transverse direction, it being furthermore possible, as an alternative for this, for both transverse directions to be secured by a corresponding form-locked engagement.

In accordance with the invention, the arrangement can be such that the rotary fork latch is provided on the end of its arm which crosses the path of movement of the closure member with a projection which extends from its wide side and cooperates with an edge-open recess extending from the wide side of the locking pawl. In the event that a securing in both transverse directions is to be provided, the projection will be allowed to enter into a recess in the wide-side wall.

In accordance with a preferred embodiment, the rotary fork latch and the locking pawl are mounted overhung and swingable in a bracket, the projection and recess lying on the side facing away from the bracket. If, accordingly, the rotary fork latch is displaced by corresponding transverse forces in the direction towards the bracket, then the projection rests against the wall of the recess extending parallel to the wide side of the locking pawl, as a result of which a firm interlocking of the parts is assured.

In order to assure a slender structural shape it is contemplated that the thickness of the projection be smaller than the thickness of the rotary fork latch and that the depth of the recess be less than the thickness of the locking pawl. Accordingly, the broad sides of rotary latch and locking pawl can be flush with each other and the form lock desired in accordance with the invention can nevertheless be obtained.

Particularly great security against the action of transverse force results from the fact that rotary fork latch and locking pawl come against each other via corresponding resting surfaces in the closed position and that the form-locked engagement is formed in the direct vicinity of the resting surfaces. Thus, even a twisting of the rotary fork latch and/or of the locking pawl does not result in the elimination of form lock desired in accordance with the invention.

Finally, the arrangement can be such that the end of the other leg of the rotary fork latch forms a form-locked engagement which is active in the direction of the support pin of the rotary form latch also in a pre-engagement position with the locking pawl. The pre-engagement position is arranged in front of the closed position in the course of the closing movement of the door and sees to it that, even if the door has not been closed properly, it cannot spring open. Thus, according to the invention, this securing position of the door is not susceptible to the action of transverse forces.

BRIEF DESCRIPTION OF THE DRAWINGS

The invention will be described in further detail below on basis of two embodiments. In the drawing.

DETAILED DESCRIPTION OF THE PREFERRED EMBODIMENT

Figure 1:
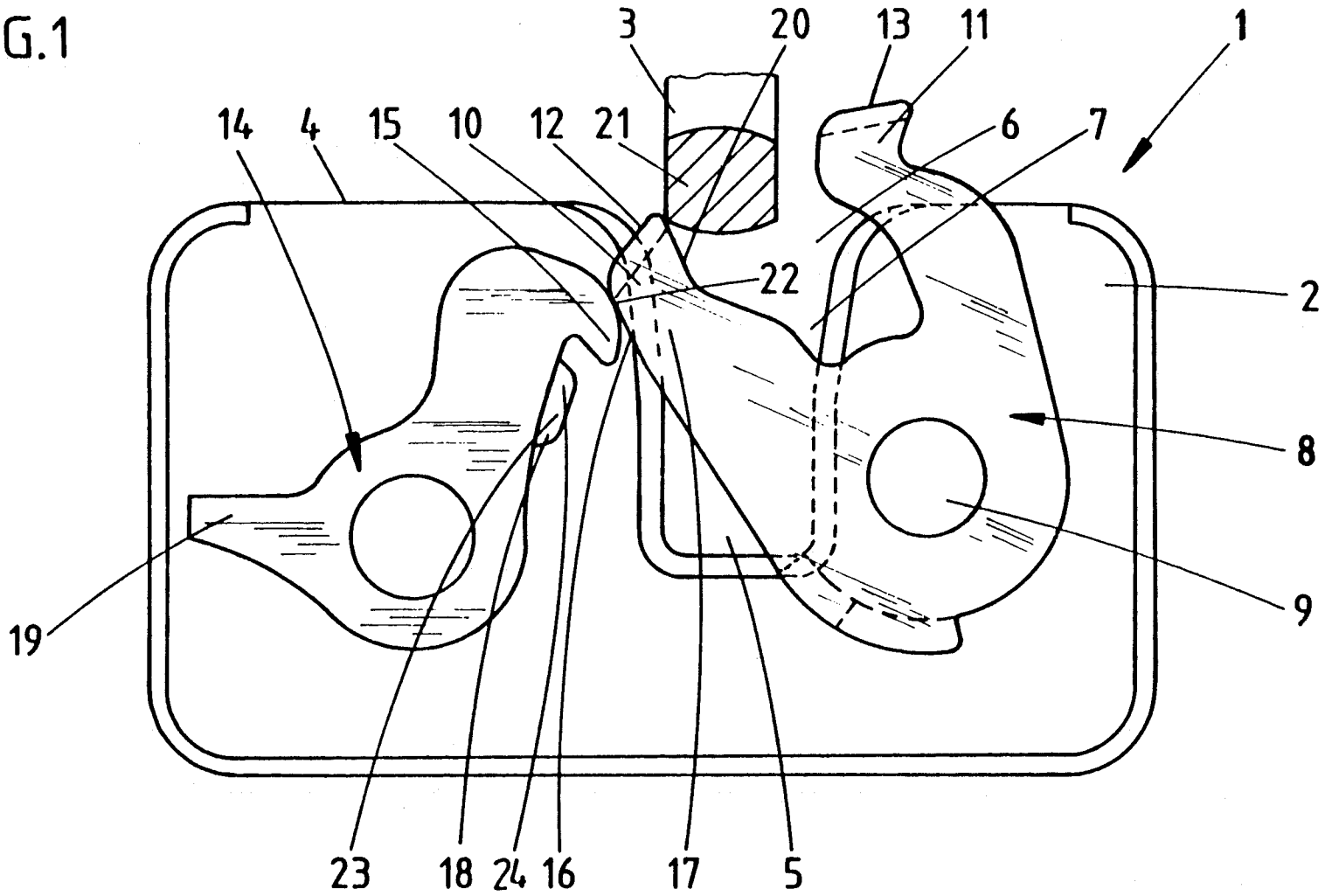
FIG. 1 shows a lock in accordance with the first embodiment, seen in the region of its inner parts, in open position with the corresponding closure member.

The lock 1 shown in FIG. 1 has a bracket 2 adapted to be fastened at a suitable place (frame) of a vehicle or the like as well as a closure member 3 of lug shape arranged on the door side. The arrangement can also be such that the closure member 3 is arranged on the frame and the bracket 2 is arranged on the door. A slot 5, which is aligned with the closing path of the closure member 3 extends from the upper edge 4 of the bracket 2 and terminates at its upper edge in a funnel-shaped widening 6. Into the region of the slot 5 and its widening 6 there extends a rotary fork latch 8 having a fork mouth 7. For its swingable mounting, there is provided a stud 9 extending from the bracket 2. On the wide sides of the ends 10, 11 of the arms of the rotary fork latch 8, on the side thereof facing away from the bracket 2, there are formed projections 12, 13, the thickness of the projections 12, 13 being less than the thickness of the rotary fork latch 8.

A locking pawl 14 mounted for swinging on the other side of the slot 5 is developed with two arms and on its one arm forms a hook-shaped locking nose 15 which, in the open position of the lock 1, acts on the facing side surface 16 of the fork arm 17. A spring (not shown) urges the looking pawl 14 in clockwise direction, producing the aforementioned position of application. Directly below the locking nose 15 the locking pawl 14 is provided, on its side facing away from the bracket 2, with a recess 18 which is open at its edge and the depth of which is less than the thickness of the locking pawl 14. By the recess 18, there is formed a nose 24. For the opening of the lock, the other lever arm of the locking pawl forms a pawl tail 19 on which an opening mechanism (not shown) acts.

Figure 2:
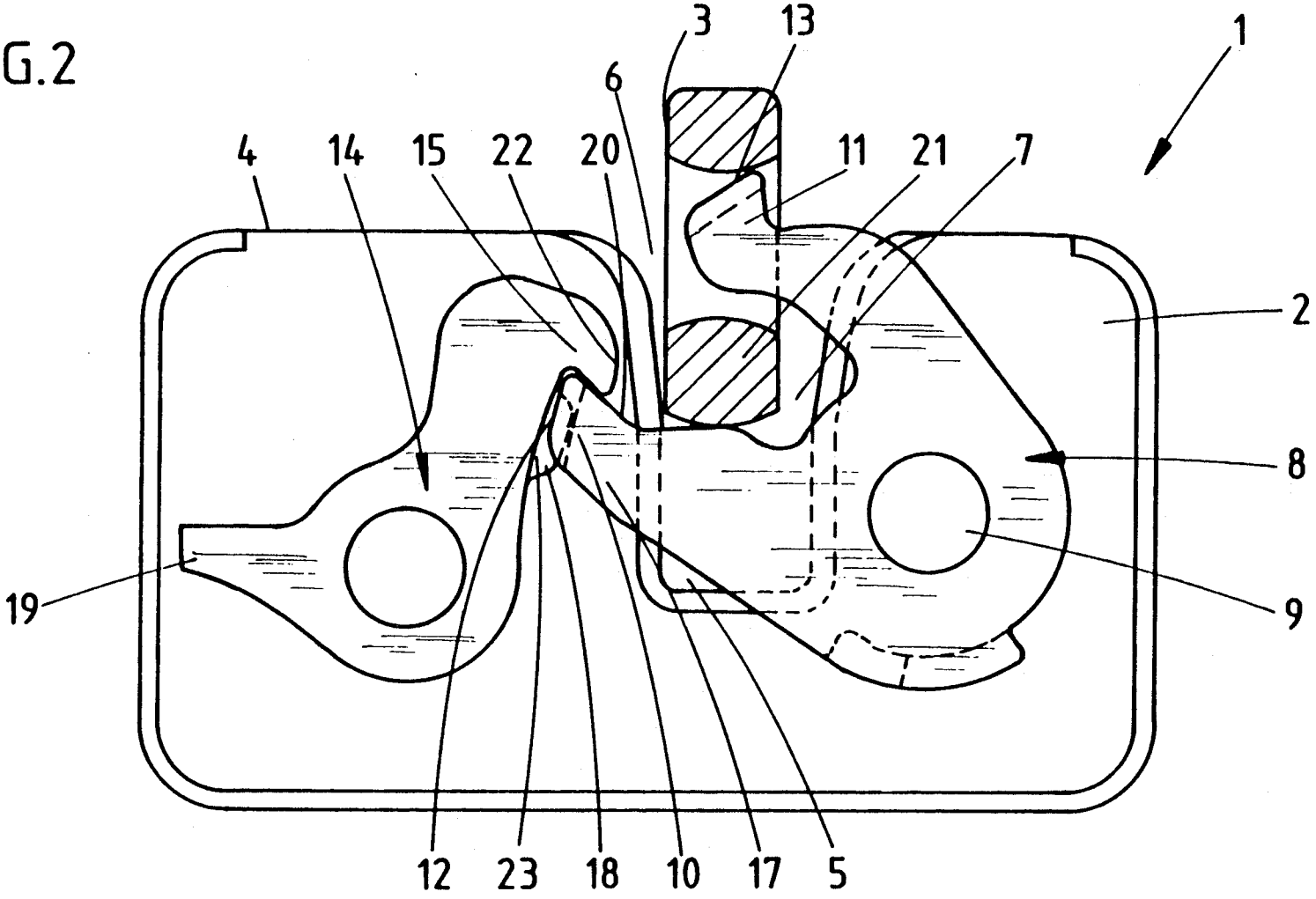
FIG. 2 is the following showing following FIG. 1, in which a rotary fork latch has moved into a pre-engagement position during the course of the closing of the door (not shown)
Figure 3:
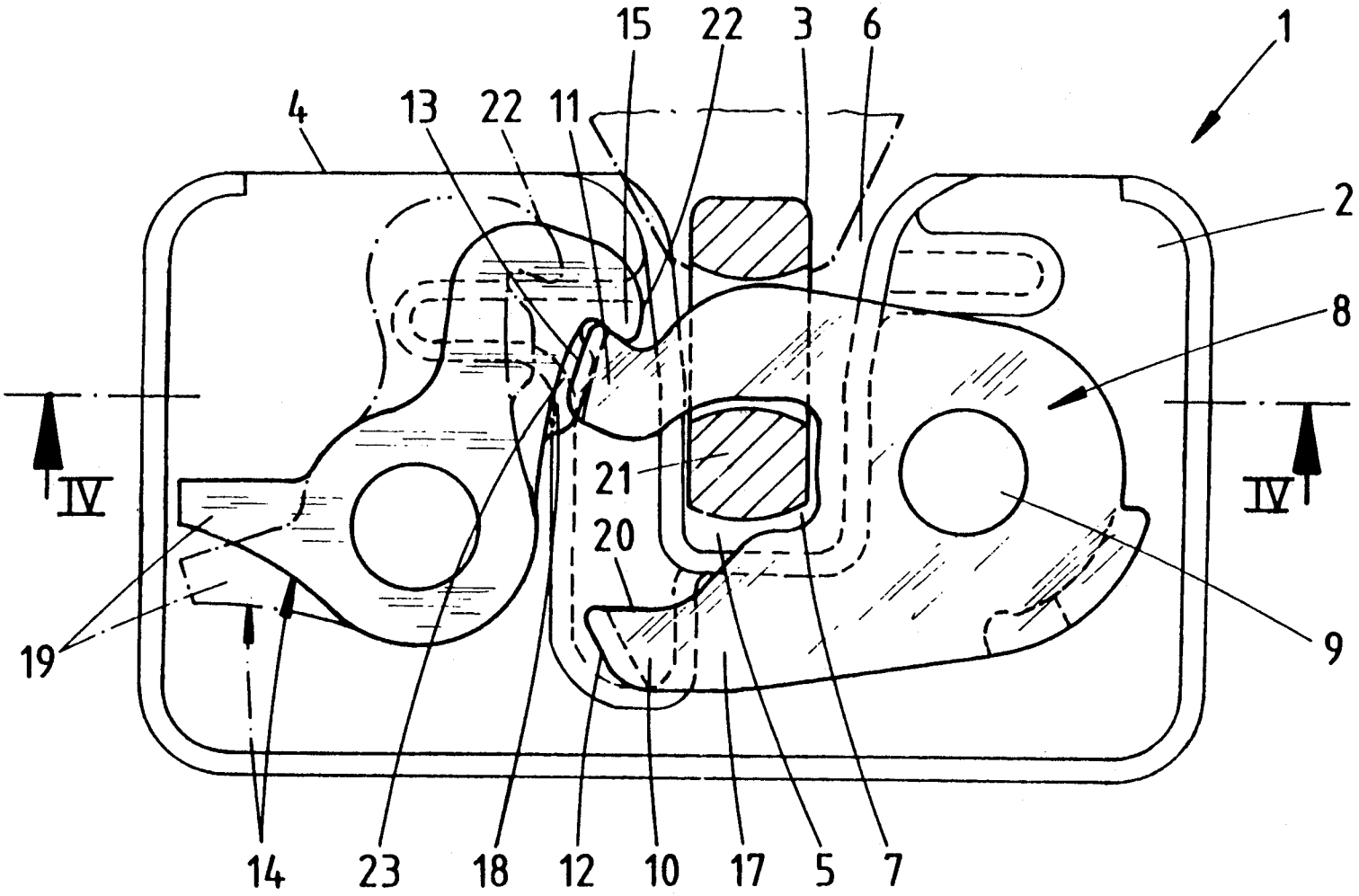
FIG. 3 shows the closed position of the lock.
Figure 4:
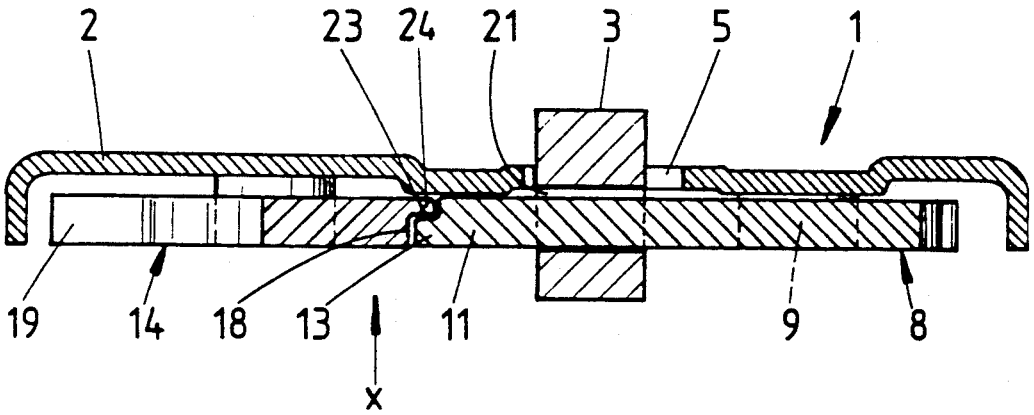
FIG. 4 is a section along the line IV—IV of FIG. 3.

The manner of operation is as follows: Upon the closing of the door, the lower transverse arm 21 of the closure member 3 comes into the region of the widening 6 of the slot 5, enters into the fork mouth 7 of the rotary fork latch 8, and acts there against the inside 20 of the fork arm 17. (See FIG. 1). Upon the further closing movement and, therefore, deeper entrance of the closure member 3 into the slot 5, the lower transverse arm 21 swings the rotary fork latch 8, the side surface 16 of the fork arm 17 striking the locking nose 15 in the region of its control surface 22 and displacing the locking pawl 14 against the action of its spring during the course of the swinging motion of the rotary fork latch 8. In the pre-engagement position shown in FIG. 2, the locking nose 15 of the locking pawl 14 extends into the fork mouth 7 and rests, via said nose, against the inside 20 of the fork arm 17. The projection 12 of the end 10 of the arm forms a form lock in this position with the recess 18 of the locking pawl 14, thus assuring that transverse forces acting on the rotary fork latch 8 in the direction X can be taken up without damage since lateral sliding of the parts is prevented due to the application of the projection 12 against the wall 23 of the recess 18. In this way, the pre-engagement position is already secured so that, even if the door is not properly closed, it is prevented from springing open under the action of a transverse force. Upon the further closing movement, the lower transverse arm 21 of the closure member 3 causes a further swinging of the rotary fork latch 8, the arm end 11 thereof in its turn coming against the control surface 22 of the locking nose 15 and thus displacing the locking pawl 14. As shown in FIG. 3, the rotary fork latch 8 in the closed position rests in the region of its arm end 11 against the inside of the locking nose 15 and is therefore secured against swinging back. The lower transverse arm 21 is caught in this position in the region of the fork mouth 7. As was the case already in the pre-engagement position, also in the closed position there is a form lock between the rotary fork latch 8 and the locking pawl 14, the projection 13 of the arm end 11 resting in the recess 18 of the locking pawl 14. If the rotary fork latch is urged in direction X towards the bracket 2 by corresponding transverse forces, then the projection 13 rests against the wall 23 of the recess 18, said wall extending parallel to the wide side of the locking pawl 14, as a result of which a firm engagement of the parts is assured. Since this form-locked engagement is formed in the immediate vicinity of the resting surfaces of the locking nose 15 of the arm end 11, even a twisting of the rotary fork latch 8 and locking pawl 14 does not cause desired form lock to be eliminated. This is true both in the closed position and in the pre-engagement position. In both positions, therefore, a firm connection is always assured.

For the opening of the door, the locking pawl 14 must be swung into a position of release (see dash-dot showing in FIG. 3). This can be done, for instance, by key actuation or from the inside of the vehicle, for which purpose a rod or the like acts on the pawl tail 19 of the locking pawl 14. Upon actuation of the opening mechanism, the locking pawl 14 is swung in counterclockwise direction. This then releases the rotary fork latch 8 which swings under spring action (not shown) into the open position and releases the closure member 3.

Figure 5:
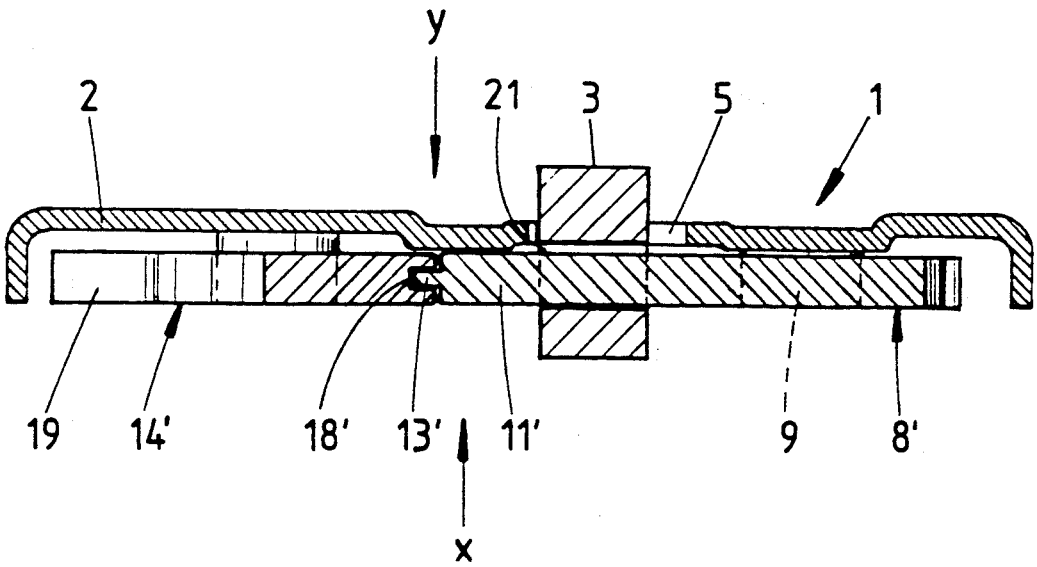
FIG. 5 is a section through the form-locked connection in accordance with a second embodiment.

FIG. 5 shows a further embodiment. The arm end 11' of the fork latch 8' shown there forms on its end surface a central projection 13' produced by edge recesses, the width of which projection is less than the width of the rotary fork latch. The locking pawl 14' has accordingly, on its end surface, a central recess 18' into which the projection 13' can enter in closed position. This form lock provides assurance that both a transverse force in direction X of the bracket 2 and a transverse force acting in the opposite direction Y can be taken up.

I claim:

1. A lock for doors, hinged covers or the like, in particular on motor vehicles, having a rotary fork latch which captures a closure member and engages with a locking pawl in closed position;

wherein the rotary fork latch and the locking pawl have configurations which mate with each other to establish an interlocking between the fork latch and the locking pawl upon their engagement, the locking preventing motion in the direction of a support pin of the rotary fork latch; and said latch has a plurality of arms defining a fork of the latch, each fork arm of the latch has an end comprising a projection, said pawl has a recess for receiving a fork-arm projection at each of a partially closed and a fully closed position of said latch.

2. A lock according to claim 1, wherein said plurality of arms of said rotary fork latch includes a first fork arm and a second fork arm defining the fork of said latch, said first fork arm leading said second fork arm upon rotation of said latch to a fully closed position of engagement with said closure member;

said latch is provided on its second arm end intersecting a path of movement of the closure member with a projection;

said second fork arm has an elongated cross-section defining a wide side and a narrow side of said second fork arm;

said locking pawl has an elongated cross-section defining a wide side and a narrow side of said locking pawl; and said projection of said second form arm extends from its wide side and cooperates with said pawl recess, said pawl recess extending from the wide side of said locking pawl.

3. A lock according to claim 1, further comprising a bracket, and said rotary fork latch and said locking pawl are mounted for swinging on said bracket, the projection of each of said arms and said recess lying respectively on the sides of said arms and said pawl facing away from said bracket.

4. A lock according to claim 1, wherein the thickness of the projection of a fork arm is less than the thickness of said rotary fork latch, and that the depth of said recess is less than the thickness of said locking pawl.

5. A lock according to claim 1, wherein said rotary fork latch and the locking pawl come against each other in a closed position; and correspondingly configured portions of said latch and said pawl mate with each other in a closed position of said latch.

6. A lock according to claim 1, wherein said plurality of arms of said rotary fork latch includes a first fork arm and a second fork arm defining the fork of said latch, said first fork arm leading said second fork arm upon rotation of said latch to a fully closed position of engagement with said closure member;

said first arm forms with the locking pawl a mating engagement to prevent motion in the direction of the support pin of said rotary fork latch in said partially closed position.

* * * * *